US007046815B2

(12) United States Patent
Akino et al.

(10) Patent No.: US 7,046,815 B2
(45) Date of Patent: May 16, 2006

(54) MICROPHONE

(75) Inventors: Hiroshi Akino, Sagamihara (JP); Tatsuo Koike, Machida (JP)

(73) Assignee: Kabushiki Kaisha Audio Technica, Tokyo (JP)

( * ) Notice: Subject to any disclaimer, the term of this patent is extended or adjusted under 35 U.S.C. 154(b) by 805 days.

(21) Appl. No.: 10/140,454

(22) Filed: May 7, 2002

(65) Prior Publication Data

US 2002/0186855 A1 Dec. 12, 2002

(30) Foreign Application Priority Data

Jun. 8, 2001 (JP) ..... 2001-173546

(51) Int. Cl.
*H04R 3/00* (2006.01)

(52) U.S. Cl. ..... 381/122

(58) Field of Classification Search ..... 381/122, 381/375, 113

See application file for complete search history.

(56) References Cited

U.S. PATENT DOCUMENTS 4,528,690 A * 7/1985 Sedgwick ..... 381/67
4,567,608 A * 1/1986 Watson et al. ..... 381/122

* cited by examiner

*Primary Examiner*—Curtis Kuntz
*Assistant Examiner*—Alexander Jamal
(74) *Attorney, Agent, or Firm*—Welsh & Katz, Ltd.

(57) ABSTRACT

The improved microphone with the removable connection to the phantom power supply facilitates the setting and provides elimination of the forgetful operation of switch-off, in e.g. convention center. The microphone provides both of manual and automatic operations of its indicator lamp having indication of the power supply, and has a manual switch which provides a common mode for operation of, and an automatic operation of both of its audio signal output and the indicator lamp. It also has a first circuit by which the indicator lamp automatically lights up, separately from the manual switch, in response to the connection to the power supply; and a second circuit by which the indicator lights out and the audio signal output is turned to off after the elapse of a predetermined time from the connection. The first and second circuits comprise respective integration circuits.

6 Claims, 1 Drawing Sheet

FIGURE
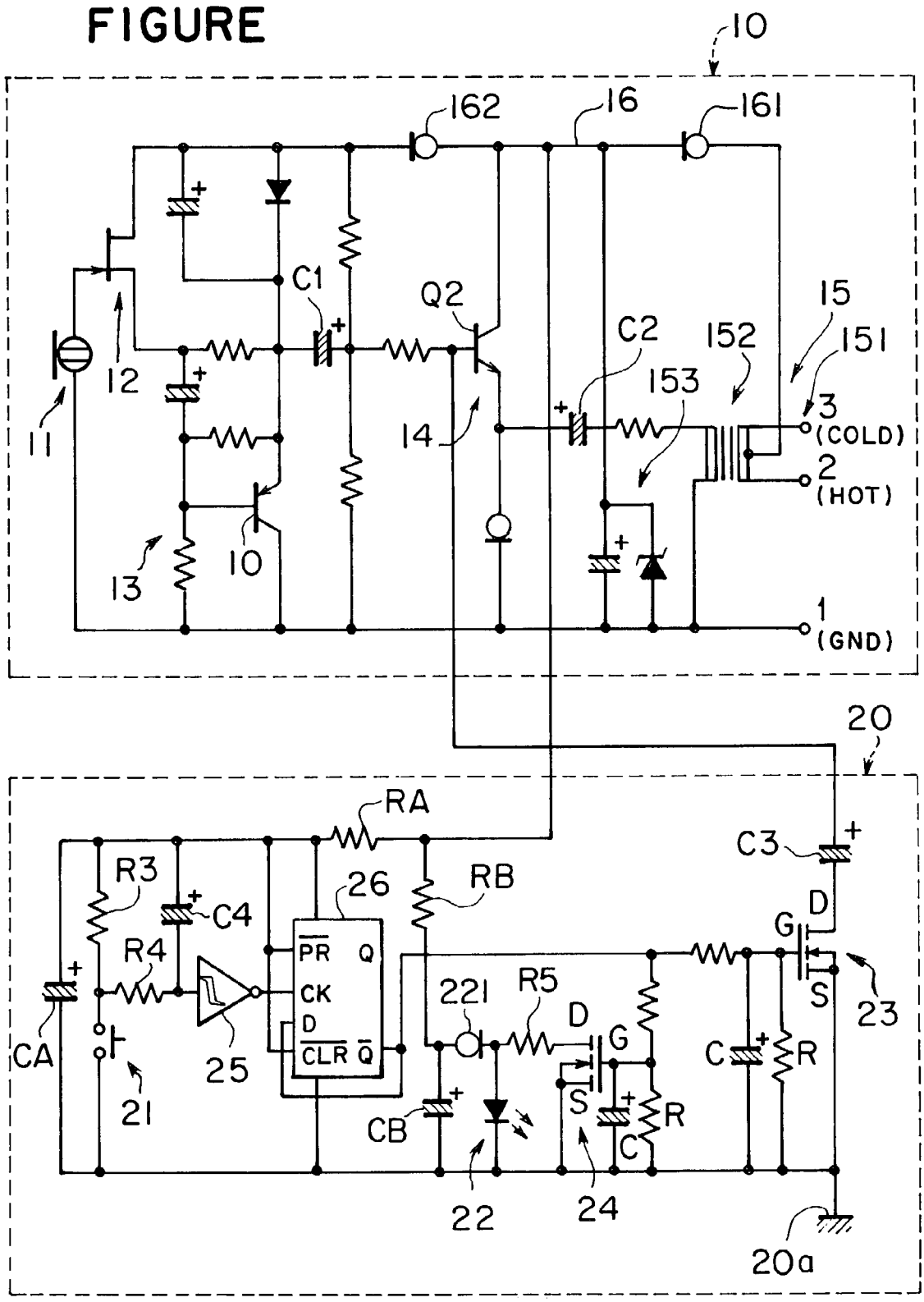

MICROPHONE

The present invention relates to a compact-designed microphone having accommodation of meeting or language laboratory facility and so on, and particularly to a microphone in which feeding from an external device having a phantom power supply is performed.

BACKGROUND OF THE INVENTION

The type of microphones are divided mainly into capacitor and dynamic microphones. Since the dynamic microphone(s) without requirement of feeding thereto have respective large appearances, it is difficult that the foregoing dynamic microphone(s) are set so as not to attract attention and catch eyes of persons in such the facility.

On the other hand, the capacitor microphone(s) require addition of a power supply for the drive. However, the microphone(s) may be constructed in smaller designs with smaller appearance, which are preferable for avoidance of attention being attracted. Therefore, the microphone(s) are mostly used in the meeting, language laboratory (LL) facility, and so on having requirement of many small microphones.

Such the meeting or LL facility has at least one socket installed in e.g., a desk or floor for feeding to respective capacitor microphone(s). Connection of a connector of the microphone to the socket by the user establishes feeding of power to the microphone, wherein the socket has a phantom power supply having two functions of power supply to the microphone and audio signal input from the microphone to an audio console.

Thus, when the participants or students in the meeting or LL facility switch on respective microphone switches to have speaking with the microphone(s), both of phantom power supply to and audio signal output from the microphone are performed.

When the participants or students have no speaking in the facility, they switch off respective microphone switches. The microphone may have an indicator lamp, e.g. a light emitting diode which is turned to on or off in accordance with the foregoing switch-on/off by the participants or students. Such the capacitor microphone(s) may have fixable or removable setting in the meeting or LL facility. It also may have integration with a headphone.

Such the capacitor microphones to be set require the user to previously check phantom power supply which should be established between the connector(s) and socket(s). Conventionally, when the user needs to know the establishment of phantom power supply, he or she has to turn on the microphone switch after connection of the connector to the socket. This is troublesome task to the user.

In addition, if the connection of the connector of the microphone to the socket by the user is carried out at switch-on of the microphone switch, the microphone will output the produced harsh, rustling noises to the speakers, headphones, and so on, or be often damaged. As forgetting to turn off the microphone switch in meeting or LL facility will cause noises (e.g. noises of the desk, paper, and so on) around the microphone to be loudened through the speakers, headphone, and so on, it will interrupt participants or students in the meeting or class.

SUMMARY OF THE INVENTION

The present invention provides solutions of the forgoing problems in checking phantom power supply to a capacitor microphone as used in e.g. a meeting or a class of foreign language.

The microphone with a capacitor microphone unit for production of audio signal output and an amplification circuit for amplifying the audio signal output from the capacitor microphone unit has a connector removably connected to a socket of an audio console, or a socket having a line or cable associated with an audio console. The connector may be of one as fixed to a housing of the microphone, or one as connected to the microphone thorough a line. The socket has a phantom power supply, wherein both of feeding to the microphone and input of the audio signal from the microphone into the audio console are performed.

The foregoing microphone has a controller having a manual switch for turning on or off the amplification circuit, and an indicator lamp lighting up or out in accordance with operation of the manual switch.

Firstly, the controller of the microphone has a first circuit having a function to light up the indicator lamp in automatic operation, in response to feeding from the socket thereto, separately from the microphone switch.

When an user uses the microphone, he or she connects the connector of the microphone to a socket installed in, e.g. a desk in front of him or her. Thus, the user can check possible drive of the microphone by the indicator lamp having automatic drive, without switching on the manual switch.

Secondly, the foregoing controller has a second circuit having a function to turn off both of the indicator lamp and acoustic output with the elapse of a predetermined period of time.

After the phantom power supply being checked by the user, the indicator lamp automatically lights out with elapse of the predetermined time period. In addition, the acoustic output is turned to off. Thus, the microphone according to the present invention does not require that the user turns off the microphone switch. Therefore, the user does not need to pay attention not so as to forget turning off the microphone switch.

The foregoing controller desires that the arrangement of the first and second circuits are on a power circuit to which the phantom power supply by the socket is fed, wherein the first and second circuits comprise integration circuits, respectively.

The first and second circuits of the controller of the microphone have constant numbers which provide establishments of period of times, respectively so as to determine the period of time that the indicator lamp continues to light up after the connector being connected to the socket associated with the audio console. Thus, the controller can control the time of period.

When the user would like to loud his or her speech through loud speakers, headphones, and etc, he or she may switch on the manual switch of the microphone. If the user switches on the manual switch before elapse of the predetermined period of time, the indicator lamp continues to light up without interruption. If the user turns on the microphone switch after elapse of the predetermined period of time, then the controller can control the indicator lamp to light up again.

When the user would like to finish his or her speech by use of the microphone, he or she may switch off the microphone switch. Then, the indicator lamp lights out, and the audio output is turned to OFF.

As stated above, the controller according to the present invention as used for a capacitor microphone provides control of the indicator lamp for indicating the phantom power supply. The foregoing first circuit of the controller allows the indicator lamp to light up in response to connection of the connector to the socket having the phantom power supply, regardless of operation of the microphone switch by the user. The foregoing second circuit of the controller allows the indicator lamp to light out after elapse of the predetermined period of time.

In addition, the controller has integration circuits for performing attenuation of noises produced in response to generation of the control signals by respective first and second circuits.

Therefore, the present invention can give the user checking of feeding to the microphone without switch-on of the manual switch, because of that the indicator lamp lights up in response to the connector being connected to the socket. It also can eliminate the problem of which the microphone requires that the user pay attention to turn off the manual switch.

BRIEF DESCRIPTION OF DRAWING

FIGURE is a circuit diagram of a microphone according to the present invention.

PREFERRED EMBODIMENTS OF THE INVENTION

Referring to FIGURE, the numeral references 10, and 20 are an audio output device, and a controller, respectively. Since the audio output device 10 on the microphone according to the present invention may be is of a general construction, only the brief description is given.

The audio output device 10 comprises a capacitor microphone unit 11 for generation of an audio signal; an impedance converter 12 which is of FET for reception of audio signals from the microphone unit; two acoustic amplification circuits, first and second acoustic amplification circuits 13, 14; and a power supply circuit 15.

The power supply circuit 15 has a connector 151; a transformer 152; and a power stabilization circuit 153. The connector 151 comprises ground, hot and cold terminal pins 1, 2, and 3 that are removably coupled to the feed socket having a phantom power supply.

Both of the hot and cold terminal pins 2, 3 are connected to the transformer 152 which is of secondary. A power line 16 is led from the transformer 152 at its secondary center tap, having constant-current diodes 161, 162. Current for drive from the connector to the power line 16 has supply of predetermined current for drive to the foregoing first and second acoustic amplification circuits 13, 14, and impedance converter 12. In addition, the power stabilization circuit 153 comprises a Zener diode and a capacitor in parallel arrangement.

According to the embodiment, the first and second acoustic amplification circuits 13, 14 have a PNP transistor Q1, and a NPN transistor Q2, respectively. The PNP transistor Q1 has its emitter connected to base of the NPN transistor Q2 through a coupling capacitor C1. The NPN transistor Q2 has its emitter connected to the transformer 152 at the first degree on one side through a coupling capacitor C2, and the transformer 152 at the first degree on the other side has connection with a ground terminal pin 1.

By the forgoing construction of the audio output device 10, the audio signal from the impedance converter 12 is amplified by the first acoustic amplification circuit 13 as well as the second amplification circuit 14. The NPN transistor Q2 of the second acoustic amplification circuit 14 provides supply of the amplified audio signal from its emitter to the transformer 152 at the foregoing first degree.

The controller 20 comprises a microphone switch 21 for turning on or off the audio signal output from the audio output device 10; a light emitting diode 22 as an indicator lamp; and a switch 23 for controlling the audio signal output, and performs a combination of turn-on/off of the indicator lamp 22 and switch 23 in response to switch on/off of the microphone switch 21. The switch 23 is, according to the embodiment, of, e.g. MOS-FET.

The microphone switch 21 of the controller 20 is of a constantly opened switch according to this embodiment, which is between its ground electrode 20*a* and power line 16 of the audio output device 10.

The controller 20 has two integration circuits therein. The first integration circuit comprises a resistance RA arranged between the microphone switch 21 and power line 16; and a capacitor CA connected to both of the ground electrode 20*a* and power line 16 in parallel arrangement with the microphone switch 21. To both of the ground electrode 20*a* and power line 16, the light emitting diode 22 is also connected.

The second integration circuit comprises a resistance RB arranged between the light emitting diode 22 on the side of the anode and the power line 16, and coupled in series to a constant current diode 221; and a capacitor CB connected to both of the ground electrode 20*a* and coupling point to the constant current diode 221 in parallel arrangement with the light emitting diode 22.

Furthermore, between the light emitting diode 22 and ground electrode 20*a*, and between the coupling point to the constant current diode 221 and ground electrode 20*a*, there is arranged a control switch 24 having control of the light emitting diode 22 to light up. The control switch 24 also is of e.g., MOS-FET. In addition, the MOS-FET 24 has a source terminal connected to the ground electrode 20*a*, and a drain terminal connected to the light emitting diode 22 as well as provision of a resistance R5 between the drain terminal and light emitting diode 22.

The switch 23 for control of the audio signal output, which is of MOS-FET has one terminal connected to the base of the transistor Q2 of the second acoustic amplification circuit 14 through a coupling capacitor C3, and the other terminal connected to the ground electrode 20*a*.

A Schmidt trigger circuit 25 is connected to the microphone switch 21 on the power line 16 to provide a pulse signal output circuit, which performs output of pulse signal "H" or "L" in response to the microphone switch 21 being switched on or off. On the side of input terminal of the circuit 25, a circuit for suppression of chattering is provided, which comprises resistances R3 and R4, and a capacitor C4.

Moreover, between the power line 16 and ground electrode 20*a*, there is also provided a dynamic flip flop (hereinafter only called flip flop) circuit 26, which has alternate drive in response to the output pulse from the Schmidt trigger circuit 25.

In accordance with this embodiment, the foregoing flip flop circuit 26 has preset and clear terminals PR and CLR connected to the power line 16; and has alternate drives in response to the input pulse into its clock CK from the Schmidt trigger circuit 25 so that produced signal for operation of the switch is outputted from Q bar terminal of the flip flop circuit 25 to gates of respective MOS-FETs 23 and 24. Additionally, on the side of the gates of the MOS-FETs, there is provided an integration circuit, which comprises RC for attenuation of noise components as caused by the changeover signal for switch having turning-on/off.

The following description will be made how the microphone according to the present invention drives. The connector 151 of the microphone is connected into a feed socket (not shown) installed in, e.g. a desk in a meeting or LL facility.

As an example, when the feed socket has a phantom power supply at voltage of DC12V, the first and second integration circuits (RA, CA and RB, CB), respectively, obtain volts of 12V for T1 and T2 which are times from the connection of the connector 151 into the feed socket to the voltage reaching. The present invention provides establishment of constant numbers between respective first and second circuits, wherein T1>T2.

The setting of the microphone by the connection of connector 151 to the phantom powered feed socket cause the power line 16 to have the volt of DC12V, wherein the second integration circuit (RB, CB) produces voltage impressed to the light emitting diode 22. In the flip flop circuit 26, the Q bar terminal output is "L" at the initial setting so as to cause both of the MOS-FETs 23, 24 to be maintained to "OFF".

With elapse of the time T2 from feeding in the microphone being set, the second integration circuit (RB, CB) obtains a predetermined volt (according to this embodiment, 12V), whereby current for drive is applied to allow the light emitting diode 22 to light up.

Thereafter, with elapse of the time T1 from feeding in the microphone being set, the first integration circuit performs supply of 12V power to allow for drive of Schmidt trigger and flip flop circuits 25, 26, wherein the Q bar output from the flip flop circuit 26 is at "H".

Hence, MOS-FET 24 is actuated to "ON" so as to cause the flow of current to the light emitting diode 22 to be turned to a flow toward the ground electrode 22*a* through the resistance R5 and MOS-FET 24. Therefore, the flow of current to the light emitting diode 22 is restricted through the constant current diode 221 so that the light emitting diode 22 lights out in the automatic operation.

In addition, MOS-FET 23 is "ON" to provide the base of the transistor Q2 of the second acoustic amplification circuit 14 down the ground electrode 20*a*, whereby the audio output from the audio output device 14 is also turned to "OFF".

As stated above, according to the invention, the light emitting diode 22 lighting up allows the user to check the drive of the microphone at setting thereof. Both of the light emitting diode 22 being lit out in the automatic operation and the audio output from the audio output device 10 being turned to "OFF" with the elapse of the predetermined time can provide elimination of e.g. the problem of that the user often forgets to switch off the microphone switch.

The microphone according to the invention has a common operation mode, after being set. Switch-on of the microphone switch 21 by the user causes the input of the Schmidt trigger circuit 25 to be turned to "L", wherein the output of the Schmidt trigger circuit 25 is turned to "H" which is a pulse with a fixed width and the input into the CK terminal of the flip flop circuit 26.

Thus, the changeover of the Q bar output of the flip flop circuit 26 from "H" to "L" provides to turn off both of the MOS-FET 23, 24, while turning on the audio output and providing to cause the light emitting diode 22 to be lit up.

Thereafter, when the user switches off the microphone switch 21 again, the flip flop circuit 26 turns "L" of the Q bar output to "H" so as to cause both of the MOS-FET 23, 24 to be "ON", wherein the audio output is turned to "OFF", and the light emitting diode 22 is lit out.

The foregoing embodiment provides employment of both of the Schmidt trigger and flip flop circuits to the construction of the control circuit, which perform alternate drives in response to the switch-on/off of the microphone switch. The control circuit may have a construction except of the forgoing one. It is possible for the control circuit to use any circuit of which has a turn of the output from "H" to "L" or from "L" to "H" in response to ON or OFF operation of the microphone switch. In addition, the changeover switches for light emitting diode and audio output also may be of construction except for MOS-FET.

The invention claimed is:

1. A microphone comprising:

means for outputting an audio signal, and means for controlling said audio signal output means, said audio signal output means comprising a capacitor microphone unit through which an audio signal is produced, amplification circuit means for amplifying the audio signal output from said microphone unit; a power circuit removably connected to a phantom power source through a connector provided thereto, said control means comprising a manual switch for manually turning on or off the output of said audio amplification circuit, and an indicator lamp lighting up in response to said manual switch being turned on/turning off and in response to said manual switch being switched off, and turned off in response to said manual switch being switched off, said control means further comprising a first circuit causing said indicator lamp to be automatically lit up, after a first predetermined period of time from a connection of the phantom power source to the microphone and a second circuit causing said indicator lamp to be automatically turned off, while turning off the output from said amplification circuit, after a second predetermined period of time from said indicator lamp lighting up has elapsed, said manual elapsed switch operating after the indicator lamp had been lit up after the first predetermined period of time from the connection of the phantom power to turn off the microphone and the indicator lamp has been turned off after the second predetermined period of time has elapsed from the indicator lamp lighting up.

2. The microphone of claim 1, wherein said first and second circuits comprise respective integration circuits connected to said power circuit, and wherein said integration circuits have predetermined time constants which are different in a period of time from each other, respectively.

3. The microphone of claim 2, wherein the time constant of said first circuit is less than one of said second circuit.

4. A microphone having a connection which comprises feeding thereto from a phantom power supply, and an audio signal output therefrom, comprising:

a controller having a manual switch for operating to turn on or off both of said feeding and audio signal output, an indicator device for providing an indication or no indication thereof in response to said manual switch being switched on or off, and an automatic switch means for providing an automatic operation for said indicator device having the indication or no indication thereof, separately from said manual switch, the automatic switch means comprising a first circuit having a first operation to cause the indicator device to have an indication a first predetermined period of time from a connection of the phantom power to the microphone, separately from said manual switch, and a second circuit having a second operation to cause the indicator device to turn the indicator and audio signal output of the indication off after a second predetermined period of time has elapsed, said manual switch operated after the indicator device has been provided with an indication after the first predetermined period of time from the connection of the phantom power to the microphone and the indicator device has been provided with no indicator after the second predetermined period of time has elapsed from the indicator device having an indication.

5. The microphone of claim 4, wherein said first and second circuits comprise respective integration circuits connected to said power circuit, and wherein said integration circuits have predetermined time constants which are different in a period of time from each other, respectively.

6. The microphone of claim 5, wherein the time constant of said first circuit is less than one of said second circuit.

* * * * *

UNITED STATES PATENT AND TRADEMARK OFFICE

CERTIFICATE OF CORRECTION

PATENT NO. : 7,046,815 B2
APPLICATION NO. : 10/140454
DATED : May 16, 2006
INVENTOR(S) : Hiroshi Akino et al.

It is certified that error appears in the above-identified patent and that said Letters Patent is hereby corrected as shown below:

first page of patent, number (73) Assignee: Instead of ….“Kabushiki Kaisha Audio Technica”;
It should be ….“Kabushiki Kaisha Audio-Technica”.

Signed and Sealed this

Seventeenth Day of October, 2006

JON W. DUDAS
*Director of the United States Patent and Trademark Office*